US006696617B1

(12) United States Patent
Cashman

(10) Patent No.: US 6,696,617 B1
(45) **Date of Patent: *Feb. 24, 2004**

(54) PROCESS FOR TREATING COMPLEX CYANIDE

(76) Inventor: Joseph B. Cashman, P.O. Box 56, Baring, WA (US) 98224

( * ) Notice: Subject to any disclaimer, the term of this patent is extended or adjusted under 35 U.S.C. 154(b) by 109 days.

This patent is subject to a terminal disclaimer.

(21) Appl. No.: 09/631,532

(22) Filed: Aug. 3, 2000

Related U.S. Application Data

(60) Provisional application No. 60/147,895, filed on Aug. 9, 1999.

(51) Int. Cl.[7] ..... A62D 3/00
(52) U.S. Cl. ..... 588/246; 588/205; 423/111
(58) Field of Search ..... 588/246, 205, 588/224, 226; 423/111

(56) References Cited

U.S. PATENT DOCUMENTS 4,059,514 A * 11/1977 Jahnsen ..... 210/721
4,145,268 A * 3/1979 Oehr ..... 204/149
6,190,626 B1 * 2/2001 Cashman ..... 423/111

FOREIGN PATENT DOCUMENTS

IN 171567 * 11/1992
WO WO 98/30499 * 7/1998 ..... C01F/7/00

* cited by examiner

*Primary Examiner*—Stuart L. Hendrickson
*Assistant Examiner*—Peter J Lish
(74) *Attorney, Agent, or Firm*—John C. Hammar

(57) ABSTRACT

The process of the present invention destroys cyanide, especially that associated with spent aluminum potliners, by reacting, in a preferred embodiment the crushed potliners with an effective amount of a mixture made from a chloride salt and bleach in cyanide destroying conditions. The chloride salty preferably is calcium chloride. The bleach is calcium or sodium hypochlorite. The reaction mixture generally also includes calcium carbonate as a source of carbon dioxide to accelerate the reaction rate.

11 Claims, No Drawings

PROCESS FOR TREATING COMPLEX CYANIDE

REFERENCE TO RELATED APPLICATION

The present application claims to benefit of U.S. Provisional Patent Application No. 60/147,895, filed Aug. 9, 1999.

TECHNICAL FIELD

The present invention relates to a process for treating complex cyanide, especially cyanide associated with spent aluminum potliners.

BACKGROUND ART

Aluminum potliners are created in the smelting of aluminum metal and its alloys. They are the liners of the pots into which the molten aluminum is poured. A typical liner lasts about five years. The Pacific Northwest aluminum producers currently annually produce about 50,000–75,000 tons of spent potliners, which are currently classified in the U.S. as hazardous waste. They contain significant concentrations of several soluble pollutants, namely, cyanides, fluorides, and heavy metals (such as lead, beryllium, and cadmium). They may also include polynuclear aromatic hydrocarbons (PNAs).

U.S. patent application Ser. No. 09/254,000 (which I incorporate by reference) describes a treatment process for spent potliners that is technically feasible at a reasonable cost (with reasonable capital cost). That process produces disposable waste products that comply with all environmental control regulations. It is robust and able to tolerate variations in the feed because spent potliners from different sources differ significantly in their makeup (that is, the process can accept widely differing feedstreams rather than requiring a particular feedstock). The process initially reacts crushed potliner with a calcium chloride/hydrochloric acid ($CaCl_2$/HCl) leach mill solution at elevated temperatures and pressures. Then, it oxidizes the PNAs with a strongly acidic FeCl3 leach mill solution in an oxygen-containing environment at elevated temperature and pressure. Cyanides are destroyed and complex fluorides converted to insoluble florspar by reacting a slurry of finely crushed potliner (⅛ inch minus) in the calcium chloride/hydrochloric acid leach mill solution at a pulp density of about 30–40%.

Comalco treats potliners using a two-step process involving a calciner to complex the cyanides followed by a hydrometallurgical step to recover the fluorides. Pechiney's SPLIT process introduces ground potliner to a hot airflow vortex rotating at supersonic speeds to destroy the cyanides followed by reacting the fluorides with an additive to produce a disposable solid waste.

The "LCLL process," Alcan's Low Caustic Leaching and Liming process, digests (leaches) finely ground spent potliner in a dilute caustic solution at around 85° C. for about one hour. Then, Alcan adds NaOH in a plugflow reactor at about 180° C. and 160 psig to destroy the cyanide in the leach solution in about one additional hour of processing while producing sodium fluoride. Finally, Alcan adds more caustic (generally, lime) to the remaining fluoride liquor for a third hour of treatment in equipment comparable to aluminum smelter wet scrubbers to produce calcium fluoride and a recyclable, caustic leach solution.

The Adrien process for treating spent potliner uses five stages to recover calcium fluoride, aluminum fluoride suitable for smelting, and to leave a carbonaceous, solid waste.

Adrien leaches the crushed potliner, washes the solid residue with two acid washes using NMF or another fluoroacid, and, finally, uses a water wash.

SUMMARY OF THE INVENTION

The process of the present invention destroys complex cyanides effectively and efficiently. In air at atmospheric pressure an effective amount of chloride salt solution, especially calcium chloride, magnesium chloride, or a mixture of these salts, and sodium or calcium hypochlorite (i.e., household bleach) react within about one hour with complex cyanide, such as cyanide complexed with iron or copper as is common with aluminum spent potliner, to reduce the cyanide. Optionally (and typically), the process also uses an effective amount of calcium carbonate as a source of carbon dioxide to accelerate the reaction, as illustrated in the formulae below. I believe that the following reactions are involved with my preferred process (using calcium salts for purposes of illustration):

$$CaCl(OCl)+CO_2+H_2O=CaCl(HCO_3)+HClO \quad (1)$$

$$HClO=HCl+O \quad (2)$$

$$2HCl+CaCO_3=CaCl_2+CO_2+H_2O \quad (3)$$

The combination of ingredients and reactants causes the cyanide to oxidize. I have not been able to destroy the cyanides in potliner using chloride salt solution alone or the hypochlorite alone, at least when the cyanide is bound with iron or copper. The chloride salt and hypochlorite together, however, provides an effective environment for destruction of the cyanides. The calcium carbonate forms carbon dioxide that appears to accelerate the destruction of the cyanide.

DETAILED DESCRIPTION OF A PREFERRED EMBODIMENT

While the chemistry involved may be useful in settings apart from destroying cyanides in spent potliner, I will describe the present invention in terms of its preferred embodiment which uses spent potliner as the source of the cyanides.

In my preferred process, I crush and grind spent aluminum potliners to produce a fine powder (generally ¼ inch minus or even ⅛ inch minus). Tables 1 summarizes typical results I achieved by processing the potliners with a calcium chloride/HCl leach using the process I described in U.S. patent application Ser. No. 09/254,000:

TABLE 1

| Element | Concentration before treatment (ppm) | Concentration after treatment (ppm) | Standard TCLP (mg/l) |
|---|---|---|---|
| Fluoride, free | 5 | 2 | 48 |
| Cyanides, Amenable ppm | 11.1 | <0.5 | 30 |
| Cyanides as total CN | 25.6 | <0.5 | 590 |

I added iron powder to the slurry of potliner with the calcium chloride/hydrochloric acid ($CaCl_2$ /HCl) leach mill solution at a pulp density of about 30–40%. The iron was at a concentration of about 5–10% by weight based upon the weight of the potliner. I destroyed essentially all of the cyanides and formed complex fluorides as insoluble florspar. Table 2 summarizes the typical results I achieved with the $CaCl_2$ /HCl leach mill solution during an initial oxidation before I reduced the pH with $H_2SO_4$.

TABLE 2

| CYANIDE TEST | EPA STANDARD | HEAD (ppm) | BALL MILL 15 min (ppm) | REACTOR 2 hrs (ppm) |
|---|---|---|---|---|
| #1 | 590 | 3786 | 356 | <0.5 |
| #2 | 590 | 846 | 86 | 5.24 |
| #3 | 590 | 590 | <25 | 0.65 |
| L11-29-A | 590 | 17980 | 103 | <0.5 |

A preferred process of the present invention destroys complex cyanides in crushed spent aluminum potliner effectively and efficiently in a fashion simpler than my earlier process. A preferred embodiment of the present invention involves reacting cyanides in large batches of crushed aluminum spent potliner in air at atmospheric pressure with a reaction mixture made from a chloride salt and bleach. The chloride salt generally is an alkaline earth metal salt, especially calcium chloride, magnesium chloride, or a mixture of those two salts. The bleach is calcium or sodium hypochlorite. Optionally (and typically) I also add calcium carbonate to the mixture to generate carbon dioxide during the reaction, which seems to have a catalytic effect. In spent potliner, the cyanide often is complexed with iron or copper. The process of the present invention within about one hour may reduce the cyanide content in crushed aluminum potliner to acceptable levels for landfill disposal per current EPA standards, which is significant because of the quantities of spent potliner generated annually. Typically 20–40 tons of spent aluminum potliner are crushed to 0.25 inch minus and mixed in an open bin with 2–5 wt. % calcium carbonate and an aqueous solution of 5–10 wt. % calcium chloride to form a thick paste like a thick cement. Then, an aqueous solution of 10–30 wt. % sodium hypochlorite is added. The bleach commonly comprises about 3–10 wt. % of the final reaction mixture. The reaction initiates upon adding the bleach and proceeds until all chlorine is consumed and the cyanide is substantially destroyed (to <25 ppm). The solid residue that remains is ready for disposal in a landfill under current standards.

I believe that the following reactions are involved with my preferred process:

$$CaCl(OCl)+CO_2+H_2O=CaCl(HCO_3)+HClO \quad (1)$$

$$HClO=HCl+O \quad (2)$$

$$2HCl+CaCO_3=CaCl_2+CO_2+H_2O \quad (3)$$

The combination of ingredients and reactants causes the cyanide to oxidize. I have not been able to destroy the cyanides using the chloride salt alone or hypochlorite alone, at least when the cyanide is bound with iron or copper. The salt and bleach together (generally, in addition, with the calcium carbonate) provides an effective environment for destruction of the cyanides in the potliner. The calcium carbonate forms carbon dioxide that appears to accelerate the cyanide destruction.

Table 3 summarizes benchscale pilot tests I conducted on crushed spent potliner (¼ inch minus) having an initial concentration of cyanide of about 4000 parts per million (ppm). All these tests used about 10 wt % $CaCl_2$ with about 10 g $CaCO_3$ and about 26 g $Ca(OCl)_2$ as the reagents.

TABLE 3

| Sample | Reaction Time (hr) | Final [CN-] (ppm) |
|---|---|---|
| 1 | 1 | 309 |
| 2 | 2 | 197 |
| 3 | 12 | 160 |
| 4 | 24 | 100+ |
| 5 | 1 | 300+ |
| 6 | 2 | 200+ |
| 7 | 36 | 282 |
| 8 | 1 | 453 |
| 9 | 2 | 545 |
| 10 | 72 | 156 |
| 11 | 1 | 197 |
| 12 | 2 | 309 |
| 13 | 24 | 100 |
| 14 | 1 | 182 |
| 15 | 2 | 264 |
| 16 | 3 | 194 |
| 17 | 23 | 144 |
| 18 | 1 | 272 |
| 19 | 2 | 220 |
| 20 | 3 | 208 |
| 21 | 20 | 183 |

Table 4 summarizes the results I achieved with similar tests on crushed spent potliner using about 10 wt % Na(OCl)2 instead of $Ca(OCl)_2$. In samples 24 and 25, I only used about 5 wt % $Na(OCl)_2$. In sample 30, I used 12% $CaCl_2$, 3% bleach, and 6% $CaCO_3$ at 80° C. under an oxygen airation.

TABLE 4

| Sample | Reaction time (hr) | Final [CN-] (ppm) | Amen Tot (ppm) | Amen CN- (ppm) |
|---|---|---|---|---|
| 22 | 1 | 119 | 196 | <25 |
| 23 | 2 | 162 | 216 | <25 |
| 24 | 1 | 383 | 375 | <25 |
| 25 | 2 | 164 | 142 | <25 |
| 26 | 1 | 780 | 273 | <25 |
| 27 | 2 | 170 | 142 | 28 |
| 28 | 1 | 231 | 162 | 69 |
| 29 | 2 | 102 | 109 | <25 |
| 30 | 1 | 76 | 458 | <25 |

Table 5 summarizes the results I achieved under differing conditions using sodium hypochlorite on crushed spent potliner. These tests used 200 g potliner with 10 g $CaCO_3$, 40 g $CaCl_2$, and 400 ml 10% $Na(OCl)_2$.

TABLE 5

| Sample | Reaction Time (hr) | Final [CN-] (ppm) |
|---|---|---|
| 31 | 1 | 231 |
| 32 | 2 | 102 |
| 33 | 1 | 780 |
| 34 | 2 | 170 |
| 35 | 1 | 119 |
| 36 | 2 | 162 |
| 37 | 1 | 383 |
| 38 | 2 | 164 |

Samples 31 and 32 were run without stirring the reaction liquor. The reaction produced considerable foam. I prefer to stir the liquor continuously throughout the reaction to ensure complete reaction. Samples 33–38 were run with potliner crushed to ¼ inch minus rather than to ⅛ inch minus, as I prefer. Samples 37 and 38 diluted the concentration of hypochlorite and used 200 ml water and 200 ml 10% $Na(OCl)_2$ i.e., about 5% bleach).

Table 6 summarizes results I achieved for calcium hypochlorite on crushed 'BQ 5429' spent potliner having an initial concentration of cyanide (CN) of about 7000 ppm. The reaction liquor contained a mixture of 20 g $CaCO_3$, 40 g $CaCl_2$, and 52 g $Ca(OCl)_2$ in 400 ml water (that is, it had about twice the concentration of calcium chloride and calcium hypochlorite over the other tests).

TABLE 6

| Sample | Reaction Time (hr) | Final [CN-] (ppm) |
|---|---|---|
| 39 | 1 | 1285 |
| 40 | 2 | 626 |
| 41 | 2 | 2304 (liquid) |
| 42 | 2 | 609 (solids) |
| 43 | 29 | 85 |
| 44 | 1 | <25 |

Samples 43 used 2% $CaCO_3$, 7% $CaCl_2$, and 4% $Na(OCl)_2$ at 30° C. Sample 44 used 3% $CaCO_3$, 12.6% $CaCl_2$, and 10% $Na(OCl)_2$ at 30° C. The feed for sample 44 had about 4000 ppm CN.

The chloride and the hypochlorite are the important agents in the reaction liquor. I am certain about the role of calcium, and do not believe that it is eesential for the reactions to occur. I believe that other alkali metal salts could be substituted for or mixed with the calcium reagents that I prefer to use. I have noticed little difference, for example, between the use of calcium hypochlorite or sodium hypochlorite. I believe they can be exchanged in all proportions without effecting the action.

I can destroy the cyanides by simply using the calcium chloride and the hypochlorite together, but the reaction rate is slow. Therefore I also prefer to include the carbonate to provide a source of carbon dioxide (Eqn. 3) in the reaction.

While I have concentrated on the destruction of cyanides in spent potliners, I believe that the reaction(s) I have discovered would work on cyanides created in other settings.

While I have described preferred embodiments of the process of the present invention and have provided examples of its operation, those skilled in the art will readily recognize alternatives, variations, alterations, or modifications of the process that might be made to the invention with departing from the inventive concept. For example, you might combine the sodium and calcium hypochlorite, carry out the reaction at elevated temperature and pressure, or introduce carbon dioxide by other means that using calcium carbonate. My chief interest is destroying cyanide in spent aluminum potliners, where the process is actually being used to treat 200–300 tons of potliner per day in 20–40 ton batches, so I have concentrated my discussion upon that application. Accordingly, interpret the description and claims broadly to protect the inventive concept. The description of the preferred embodiments and the examples are given to illustrate the invention rather than to limit it. Only limit the invention as is required to distinguish the invention from the prior art.

I claim:

1. A process for treating spent aluminum potliner comprising the steps of:

(a) crushing the potliner;

(b) mixing the crushed potliner in an open bin in air at atmospheric pressure with an effective amount of a chloride salt solution to form a paste; and (c) adding hypochlorite solution to the paste to form a chloride-hypochlorite mixture effective at destroying cyanide in the potliner in air at atmospheric pressure.

2. A process for treating cyanide complexed with a metal, comprising the steps of:

forming a paste by combining an effective amount of a chloride salt and calcium carbonate in an amount effective to accelerate the reaction by producing carbon dioxide;

diluting the paste by adding an aqueous solution of 10–30 wt. % hypochlorite to form a mixture; and reacting the cyanide with the mixture, wherein the chloride salt and the hypochlorite are present in an effective amount to destroy the cyanide in air at atmospheric pressure under cyanide-destroying conditions.

3. The process of claim 1 further comprising the step of adding an effective amount of calcium carbonate to accelerate the reaction by producing carbon dioxide.

4. The process of claim 1 wherein the chloride salt is selected from the group consisting of calcium chloride, magnesium chloride, and mixtures thereof.

5. The process of claim 2 wherein the chloride salt is selected from the group consisting of calcium chloride, magnesium chloride, and mixtures thereof.

6. The process of claim 2 wherein the cyanide is associated with spent aluminum potliner.

7. The process of claim 6 wherein the cyanide is complexed with iron or copper or both.

8. The process of claim 7 wherein the hypochlorite comprises 3–10 wt% of a reaction mixture of the potliner and other reactants.

9. The process of claim 1 wherein the crushed potliner weighs 20–40 tons.

10. The process of claim 9 wherein the chloride salt comprises 5–10 wt % of a reaction mixture of the potliner and other reactants.

11. The process of claim 2 further comprising stirring the cyanide and other reactants throughout the reaction.

* * * * *